United States Patent [19]

Pottick

[11] Patent Number: 5,071,387

[45] Date of Patent: Dec. 10, 1991

[54] FIGURINE-SHAPED WATER SQUIRTING TOY

[75] Inventor: Murray Pottick, Demerest, N.J.

[73] Assignee: Multi Toys Corp., Cresskill, N.J.

[21] Appl. No.: 615,280

[22] Filed: Nov. 19, 1990

[51] Int. Cl.[5] ..... A63H 33/30; A63H 3/00; A63H 3/52; B65D 88/54

[52] U.S. Cl. ..... 446/475; 446/268; 446/267; 446/74; 222/78; 222/341

[58] Field of Search ..... 446/475, 473, 260, 267, 446/308, 309, 310, 330, 176, 183, 196, 197, 74; 222/78, 341, 385

[56] References Cited

U.S. PATENT DOCUMENTS

| | | | |
|---|---|---|---|
| 928,059 | 7/1909 | Lippstadt | 222/341 X |
| 1,266,106 | 5/1918 | Coup | 446/197 X |
| 1,893,972 | 1/1933 | Whitman | 446/475 X |
| 3,388,835 | 6/1968 | Naughten | 222/78 |
| 3,420,412 | 1/1969 | Greene | 222/78 |
| 4,193,517 | 3/1980 | Fetty et al. | 222/78 |
| 4,578,045 | 3/1986 | Mayer et al. | 446/330 |
| 4,601,672 | 7/1986 | Cook et al. | 446/330 |
| 4,623,319 | 11/1986 | Zaruba et al. | 446/475 X |
| 4,630,756 | 12/1986 | Amici et al. | 446/475 X |
| 4,982,874 | 1/1991 | Pringle | 446/475 X |

FOREIGN PATENT DOCUMENTS

| | | | |
|---|---|---|---|
| 1084950 | 1/1955 | France | 446/183 |
| 1258323 | 12/1971 | United Kingdom | 446/268 |

*Primary Examiner*—David N. Muir

*Attorney, Agent, or Firm*—Kirschstein, Ottinger, Israel & Schiffmiller

[57] ABSTRACT

A figurine-shaped toy squirts water out of its mouth by cranking an arm.

8 Claims, 2 Drawing Sheets

FIGURINE-SHAPED WATER SQUIRTING TOY

BACKGROUND OF THE INVENTION

1. Field of the Invention

This invention generally relates to a water squirting toy and, more particularly, to a toy that squirts water from the mouth of a figurine-shaped housing by manually displacing one of the arms of the figurine-shaped housing.

2. Description of Related Art

Water guns have long offered many hours of fun for children. Yet, playing with gun-shaped toys is not universally acceptable. In any event, once the guns are seen, many potential human targets are forewarned that they will soon be squirted. It would be desirable to conceal the water squirting function of such a toy and to provide additional play value.

SUMMARY OF THE INVENTION

1. Objects of the Invention

It is an object of this invention to conceal the water squirting function of water squirting toys.

Another object of this invention is to increase the play value of water squirting toys.

2. Features of the Invention

In keeping with these objects, and others which will become apparent hereinafter, one feature of this invention resides, briefly stated, in a water squirting toy that comprises a figurine-shaped housing. The housing has a torso, a head connected to and above the torso, as well as a mouth, two arms connected to opposite sides of the torso, and two legs connected to and below the torso. One of the arms is mounted for manual displacement relative to the torso.

The housing has an interior, a water inlet, and a water outlet at the mouth of the head. Water is admitted into the water inlet for storage in the interior of the housing.

Pumping means are provided in the interior of the housing. The pumping means is operative for manually pumping stored water through the water outlet by manually displacing said one arm.

In a preferred embodiment, the displaceable arm is pivotably mounted for turning movement on the torso. The pumping means includes a water pump having a reciprocating piston, and a force-transmitting transmission for transmitting the turning displacement of the displaceable arm to the piston to reciprocate the same. The transmission includes an eccentric cam having a cam follower surface in engagement with the piston. By cranking the displaceable arm, the cam is turned through a limited range of angular movement which, in turn, causes the piston to be moved up and down, thereby causing the pump to deliver water under pressure to the water outlet for discharge therefrom.

The water pump has a pump inlet, and a feed tube connected thereto. The feed tube is a flexible hose that extends along, and within, one of the legs. The pump also has a pump outlet and a delivery tube. Also, a flexible hose is connected to the pump outlet. The delivery tube extends to the water outlet at the mouth.

Due to the figurine-like shape of the housing, the fact that the toy is a water gun is concealed from potential human targets. Also, when not in use as a water gun, the housing makes for a convenient doll, thereby increasing the overall play value of this toy.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
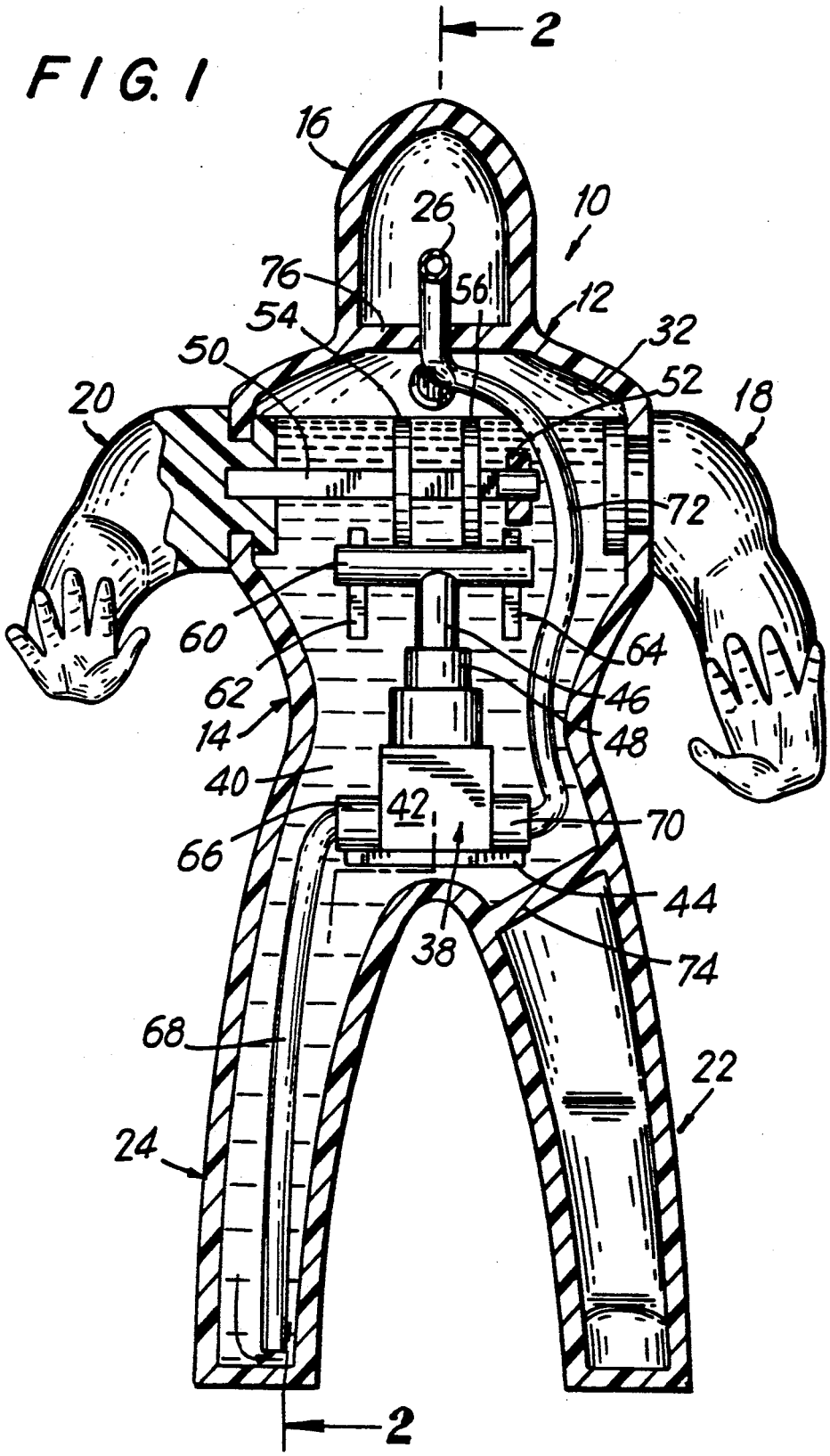
FIG. 1 is a partly sectioned front view of a water squirting toy according to this invention.

Referring now to the drawings, reference numeral 10 generally identifies a water squirting toy that includes a figurine-shaped housing 12. Housing 12 has a hollow torso 14, a hollow head 16 connected to and above the torso 14, two arms 18,20 connected to opposite sides of the torso 14, and two legs 22,24 connected to and below the torso 14. The head 16 has a mouth 26. Arm 18 is fixedly mounted on the torso 14. Arm 20 is mounted for manual displacement relative to the torso 14.

Figure 2:
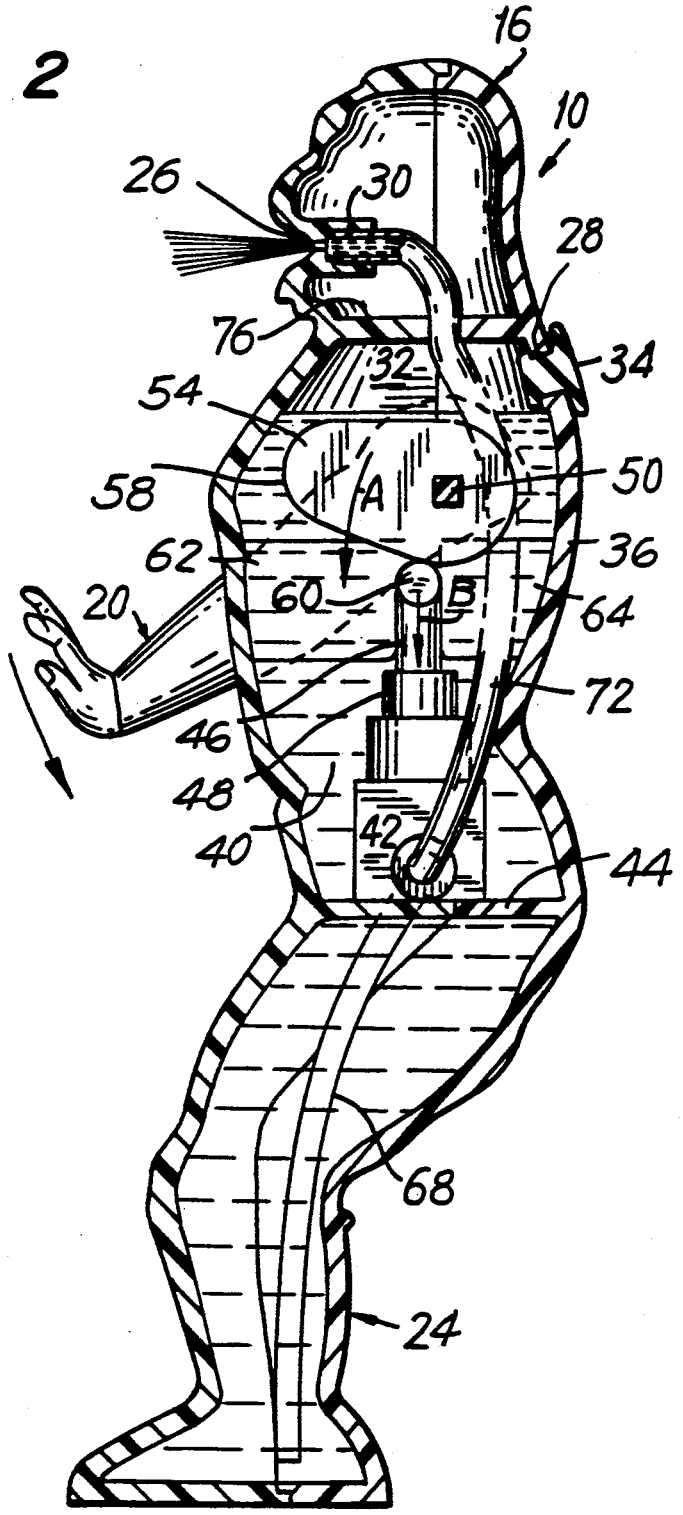
FIG. 2 is a sectional view taken on line 2—2 of FIG. 1.

As best shown in FIG. 2, the housing 12 has a water inlet 28, a water outlet 30 at the mouth 26, and an interior 32.

Water 40 is admitted through the inlet 28 for storage in the interior 32 of the housing. A plug 34 is friction-tightly received in, and sealingly engages, the inlet 28 to prevent water within the interior 32 from escaping. The plug 34 and inlet 28 are advantageously located on a back wall 36 of the housing for esthetic purposes.

Pumping means 38 are provided in the interior 32 of the housing. The pumping means is operative for manually pumping stored water 40 through the water outlet 30 by manually displacing arm 20. The pumping means 38 includes a water pump 42 mounted within the torso 14 on a support wall 44. Pump 42 has a reciprocating piston 46 which slides up and down along a vertical axis out and into a cylinder 48.

The pumping means further includes a force-transmitting transmission for transmitting the displacement of the arm 20 to the piston 46 for reciprocating the same. The arm 20 is mounted for pivoting movement on the torso 14 by a shaft 50. One end of the shaft 50 is fixedly connected to the arm 20; and the other end of the shaft 50 is journaled in a bearing 52 within the torso 14. The shaft 50 has a generally circular cross-section at its ends, and has a square-shaped cross-section in an intermediate region between its ends. A pair of eccentric cams 54, 56 is mounted on the square-shaped section of the shaft 50. As best shown in FIG. 2 for representative cam 56, each cam has a cam follower surface 58 in engagement with the piston 46. The piston 46 has a transverse cross bar 60 fixedly connected thereto and guided in the up-and-down direction by guides 62,64 integral with the housing. A non-illustrated spring serves to constantly bias the piston 46 toward and into engagement with the cam follower surfaces 58.

The pump 38 has a pump inlet 66 to which one end of a feed tube 68 is connected. The feed tube extends along and within leg 24 to the bottom thereof. The pump also has a pump outlet 70 to which one end of a delivery tube 72 is connected. The delivery tube 72 extends and is connected to the water outlet 30 at the mouth 26.

Advantageously, both the feed and delivery tubes are made of a flexible, synthetic plastic material hose.

In operation, the interior 32 of the housing is filled with water 40. As illustrated, the water 40 fills the hollow torso 14 and the hollow leg 24. If more water storage is needed, then the leg 22 could likewise be filled with water. In this case, such additional water storage is not necessary, and entrance to the interior of the leg 22 is prevented by blocking wall 74. Entrance to the head 16 is also prevented by blocking wall 76. The plug 34 is sealed into the inlet 28.

Thereupon, by repetitively turning the displaceable arm 20 about the shaft 50 through a limited range of angular movement, the eccentric cams 54,56 are circumferentially moved in the direction of the arrow A, thereby urging the piston 46 downwardly in the direction of the arrow B. This action causes the pump 38 to develop a partial vacuum therein and suck water at the bottom of the leg 24 through the feed tube 68, into the pump inlet 66, and to discharge the sucked-in water under pressure through the pump outlet 70 along the delivery tube 72 for discharge out through the water outlet 30 and the mouth 26. The repetitive cranking of the arm 20 causes multiple water bursts to be emitted from the mouth 26.

The housing is preferably constituted of rigid, synthetic plastic material, preferably opaque to conceal the submerged pump, transmission and tubes therein.

It will be understood that each of the elements described above, or two or more together, also may find a useful application in other types of constructions differing from the types described above.

While the invention has been illustrated and described as embodied in a figurine-shaped water squirting toy, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A water squirting toy, comprising:

(a) a figurine-shaped housing having a hollow torso, a head connected to and above the torso, said head having a mouth, two arms connected to opposite sides of the torso, one of said arms being mounted for manual displacement relative to the torso, and two legs connected to and below the torso, said housing having a water inlet, a water outlet at the mouth, and an interior;

(b) means for admitting water into the water inlet for storage in the interior of the torso; and (c) pumping means in the interior of the torso, for manually pumping stored water through the water outlet by manually displacing said one arm, said pumping means including a water pump submerged in the water in the torso, said pump having a pump outlet, and a delivery tube connected to the pump outlet and extending to the water outlet at the mouth.

2. The toy according to claim 8, wherein said one arm is pivotably mounted for turning displacement on the torso, and wherein the water pump has a reciprocating piston, and a force-transmitting transmission for transmitting the turning displacement of said one arm to the piston to reciprocate the piston.

3. The toy according to claim 2, wherein the transmission includes an eccentric cam having a cam follower surface in engagement with the piston.

4. The toy according to claim 1, wherein one of the legs is elongated, hollow and stores water therein, and wherein the pump has a pump inlet and a feed tube connected to the pump inlet, said feed tube extending along and within said one leg.

5. A water squirting toy, comprising:

(a) a figurine-shaped housing having a hollow torso, a head connected to and above the torso, said head having a mouth, two arms connected to opposite sides of the torso, one of said arms being mounted for manual displacement relative to the torso, and two legs connected to and below the torso, one of the legs being elongated and hollow, and an interior;

(b) means for admitting water into the water inlet for storage in the interior of the torso and said one leg; and (c) pumping means in the interior of the torso, for manually pumping stored water through the water outlet by manually displacing said one arm, said pumping means including a water pump submerged in the water in the torso, said water pump having a pump inlet, and a feed tube connected to the pump inlet and extending along and within said one leg.

6. The toy according to claim 9, wherein the pump has a pump outlet and a delivery tube connected to the pump outlet, said delivery tube extending to the water outlet at the mouth.

7. A water squirting toy, comprising:

(a) a figurine-shaped housing having a hollow torso, a head connected to and above the torso, said head having a mouth, two arms connected to opposite sides of the torso, one of said arms being mounted for manual displacement relative to the torso, and two legs connected to and below the torso, one of the legs being elongated and hollow, said housing having a water inlet, a water outlet at the mouth, and an interior;

(b) means for admitting water into the water inlet for storage in the interior of the torso and said one leg; and (c) pumping means in the interior of the torso, for manually pumping stored water through the water outlet by manually displacing said one arm, said pumping means including a water pump submerged in the water in the torso, said pump having a pump outlet, and a delivery tube connected to the pump outlet and extending to the water outlet at the mouth, said water pump having a pump inlet, and a feed tube connected to the pump inlet and extending along and within said one leg.

8. The toy according to claim 7, wherein each tube is a flexible hose of synthetic plastic material.

* * * * *